US011417971B2

(12) United States Patent
Pawlak et al.

(10) Patent No.: US 11,417,971 B2
(45) Date of Patent: Aug. 16, 2022

(54) ASSEMBLY ELEMENT FOR AN ACTUATOR

(71) Applicant: ZF Friedrichshafen AG, Friedrichshafen (DE)

(72) Inventors: Florian Pawlak, Friedrichshafen (DE); Tobias Nusser, Friedrichshafen (DE); Karlheinz Mayr, Bregenz (AT); Oliver Küpfer, Gräfenberg (DE); Markus Moosmann, Grünkraut (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 16/797,263

(22) Filed: Feb. 21, 2020

(65) Prior Publication Data

US 2020/0274266 A1 Aug. 27, 2020

(30) Foreign Application Priority Data

Feb. 22, 2019 (DE) ..... 102019202444.0

(51) Int. Cl.

| | |
|---|---|
| ***H01R 9/16*** | (2006.01) |
| ***H01R 4/70*** | (2006.01) |
| ***H01R 13/40*** | (2006.01) |
| ***H01R 103/00*** | (2006.01) |

(52) U.S. Cl.

CPC ..... *H01R 9/16* (2013.01); *H01R 4/70* (2013.01); *H01R 13/40* (2013.01); *H01R 2103/00* (2013.01); *H01R 2201/26* (2013.01)

(58) Field of Classification Search

CPC ..... H01R 13/53; H01R 24/28; H01R 13/02

See application file for complete search history.

(56) References Cited

U.S. PATENT DOCUMENTS

| | | | | |
|---|---|---|---|---|
| 6,186,022 | B1 * | 2/2001 | Ishikawa | B60Q 1/425 200/61.3 |
| 7,077,703 | B2 * | 7/2006 | Herlitz | H01R 13/648 439/607.04 |
| 7,789,690 | B1 * | 9/2010 | Rhein | H01R 13/53 439/310 |
| 2014/0339057 | A1 * | 11/2014 | Lipfert | B60Q 1/0076 200/61.27 |
| 2019/0334299 | A1 * | 10/2019 | Tsai | H01R 24/60 |
| 2020/0395711 | A1 * | 12/2020 | Klein | B23K 9/323 |

FOREIGN PATENT DOCUMENTS

| | | |
|---|---|---|
| DE | 10 2018 203 970 A1 | 9/2019 |
| DE | 10 2018 203 991 A1 | 9/2019 |
| WO | WO 2019/174853 A1 | 9/2019 |
| WO | WO 2019/174854 A1 | 9/2019 |

OTHER PUBLICATIONS

Office Action dated Oct. 15, 2019 for German Patent Application No. 10 2019 202 444.0, (12 pp.), note: pp. 1 and 2 are English language Explanations to Section C. Result of Determination Document.

* cited by examiner

*Primary Examiner* — Jean F Duverne
(74) *Attorney, Agent, or Firm* — Crowell & Moring LLP

(57) ABSTRACT

An assembly element for establishing an electrical contact to an actuator for a vehicle transmission may include a base plate and two electrical circuit points projecting on one side of the base plate for the assembly element. The assembly element has a shavings protection device provided at least partially between the electrical circuit points, which is designed to at least partially impede a short circuit between the contacts when the assembly element is in contact with the actuator.

20 Claims, 3 Drawing Sheets

ASSEMBLY ELEMENT FOR AN ACTUATOR

RELATED APPLICATION

This application claims the benefit and priority of German Patent Application DE 10 2019 202 444.0, filed Feb. 22, 2019, which is incorporated by reference herein in its entirety.

TECHNICAL FIELD

The present disclosure relates to an assembly element for connecting to an actuator for a vehicle transmission and a system comprising the assembly element and the actuator for the vehicle transmission.

BACKGROUND

Various constructions are currently used for creating an electrical connection or contact to a circuit board built into an actuator for a vehicle transmission.

The electrical contact to the circuit board can be obtained using so-called spring-pressure contacts, wherein there are usually two spring-pressure contacts for each actuator. This type of contact requires a certain contact force between the spring-pressure contacts and the circuit board. A height offset of the two spring-pressure contacts can result from an alignment of the actuator, requiring a small structural tolerance to ensure an uninterrupted contact. In addition, a distance that is to be bridged via numerous hydraulic plates can lead to a further increase in the structural tolerance. The increasing structural tolerance requires an increased contact force and a very precise alignment of the actuators, which is only possible through an expensive reduction of the twisting angle of the actuator.

As an alternative to the spring-pressure contact, a knife-fork contact can also be used as the contact element in conjunction with a module in which the construction and connection technology is obtained via a lead frame. This variation is extremely complex using circuit board technology, however. Therefore, as an alternative to circuit board technology, the connection to the contact blade can be obtained with a wire-crimping unit.

With all of the aforementioned contacts, however, protection against conductive abrasion in the vehicle transmission fluid, e.g. floating electrically conductive shavings, is a challenge. More precisely, this abrasion, or these shavings, can result in an electrically conductive connection between the contacts on the assembly element and/or the actuator, and thus cause a short circuit.

DETAILED DESCRIPTION

Figure 1:
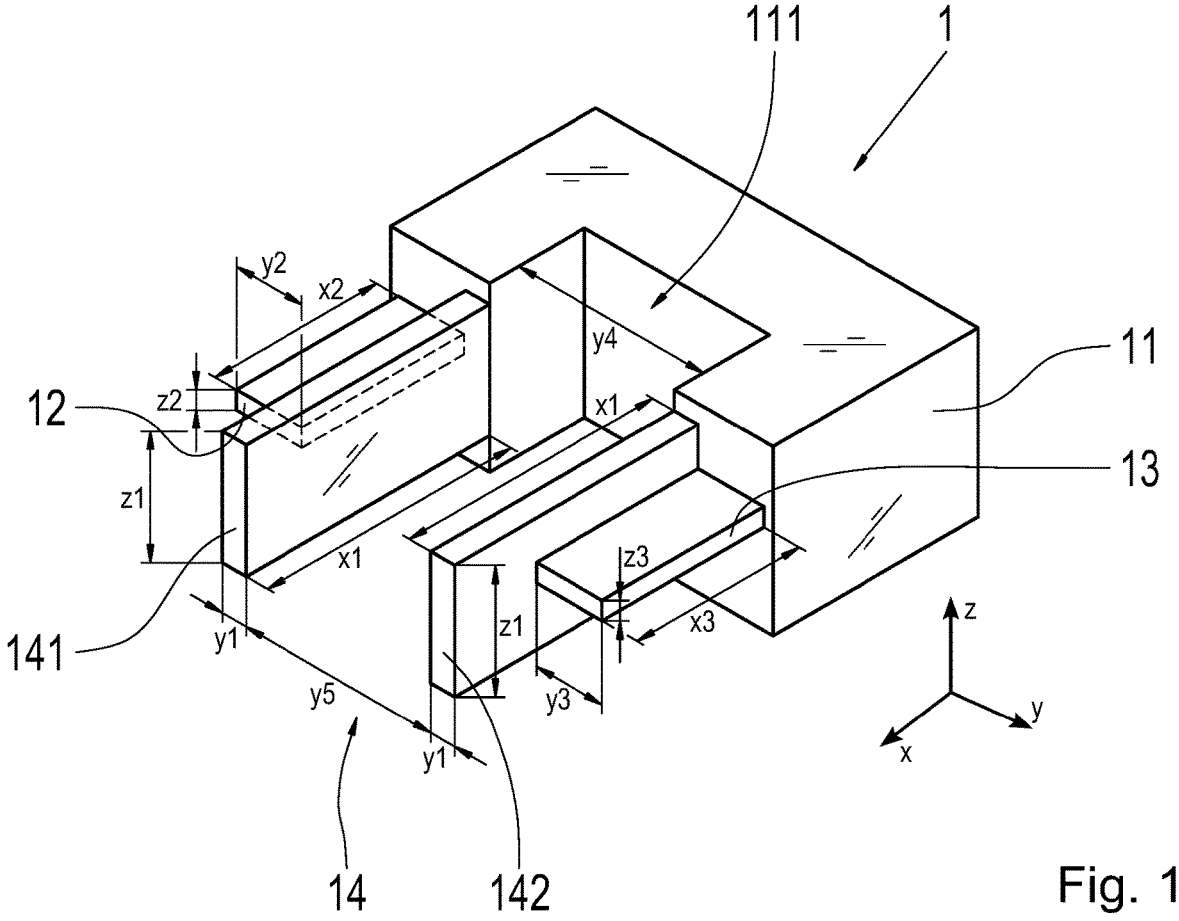
FIG. 1 shows a schematic and perspective illustration of an assembly element according to one embodiment.

One object of the present disclosure is therefore to prevent such a short circuit in all tolerances and positions of the contact, more precisely, to create an effective protection against shavings. There is also a desire to obtain a contact with the individual actuators by means of an assembly element that likewise ensures protection against the shavings contained in the transmission fluid.

This object is achieved with an assembly element and a system according to the independent claims. Advantageous embodiments are described in the dependent claims.

In the present case, an assembly element for establishing an electrical contact between an actuator for a vehicle transmission and a base plate and two electrical circuit points protruding on one side of the base plate of the assembly element is provided. The assembly element also has shavings protection device located at least partially between the electrical circuit points, which is configured to at least partially impede a short circuit between the contacts when the assembly element is in contact with the actuator. The assembly element is an electronic connecting element that is designed to transmit electrical energy and signals from an input side to an output side and back. The assembly element can comprise, e.g., a first electrical circuit point for establishing contact with a first circuit point on the actuator, and a second electrical circuit point for establishing contact with a second circuit point on the actuator.

The shavings protection device is provided such that at least a section of the shavings protection device is bisected by an imaginary line extending from the first electrical circuit point to the second electrical circuit point. This means that by providing the shavings protection device between the first and second electrical circuit points, it is not possible to obtain a straight connection between the electrical circuit points in sections, without cutting through the shavings protection device. The base plate is a component preferably made of plastic or some other material with the similar lower conductivity of plastic. The base plate and/or shavings protection device is preferably non-conductive, wherein the base plate and/or shaving protection can either be an integral part of the upper or lower half, or connected thereto in the form of an injection molded component.

The shavings protection device preferably has a non-conductive material, which has a low or negligible electrical conductivity in comparison with the first and second electrical circuit points. The shavings protection device is provided such that it prevents or at least impedes a short circuit between the electrical circuit points. This assembly element can also be used as a retrofitting solution for previously installed actuators, or mass produced actuators, because the shavings protection device is at least partially advantageously obtained on the assembly element. In other words, the assembly element itself acts as a labyrinth seal, and makes it difficult for conductive shavings in the vehicle transmission fluid to electrically connect the circuit points. The reliable insulation is based on an extension of a pathway between the circuit points, or for connecting the circuit points. The shavings protection device therefore forms an integral barrier or impediment with the assembly element, which a shaving or some other conductive object, e.g. oil containing conductive abrasives, must avoid in order to come in contact with both circuit points, and therefore be able to establish an electrical connection.

The two electrical circuit points can project from the base plate in an insertion direction into the assembly element, and the shavings protection device can extend in the insertion direction. The shavings protection device can extend in the insertion direction, substantially parallel to the two electrical circuit points. The shavings protection device can extend over the two electrical circuit points in the insertion direction. The insertion direction corresponds to a direction in which the assembly element must be moved in order to bring the circuit points on the actuator in contact with the two circuit points on the assembly element. The components characterized as belonging to the actuator are components of the actuator and not the assembly element, i.e. the actuator has the actuator-side components. The components characterized as belonging to the assembly element are components of the assembly element and not the actuator, i.e. the assembly element has the assembly element-side components. The two circuit points preferably pass through or enter the two circuit points on the base plate.

The base plate is preferably designed such that contact can be established with both electrical circuit points from one side of the base plate. This side is preferably a side of the base plate lying opposite the side where the electrical circuit points are located in the insertion direction. This opposite side preferably has cut-outs, e.g. holes, connecting the opposite side with the two electrical circuit points. As a result, a further electrical lead can be brought in contact with the two electrical circuit points through the cut-outs.

The two circuit points preferably project at a substantially right angle to one side of the base plate, and form a so-called blade contact, which can be received in a so-called fork contact on the actuator. The base plate is preferably a rectangular solid, or at least a partially rectangular solid. The base plate preferably has a mechanical stop projecting substantially at a right angle to the insertion direction, or two mechanical stops projecting substantially at a right angle to the insertion direction. Each stop is preferably in contact with a housing for the actuator when the assembly element is inserted.

The base body can also have one or two latching elements. The latching elements are preferably secured on preferably two lateral surface(s) of the base plate. The latching elements can extend substantially parallel to the insertion direction and toward the front at a spacing to the lateral surfaces. The latching elements preferably exhibit a certain elasticity. The latching elements preferably have a projecting section on their front end in the insertion direction, extending toward the lateral surface of the base plate, which is configured to encompass a snap-in section on the actuator. The latching elements can be used to fasten or secure the assembly element on the actuator, preferably in the insertion direction.

The electrical circuit points can be plate-like. The shavings protection device can have a first insulating device and a second insulating device. The insulating devices can be plate-like, and each insulating device can be dedicated to one of the electrical circuit points. The insulating devices can form a T-shaped cross section with the respective electrical circuit point to which it is dedicated. In other words, the plate-like insulating devices are substantially perpendicular to the respective electrical circuit points to which they are dedicated. "Plate-like" in this case means that both the electrical circuit points and the insulating devices are flat, having the same substantial thickness throughout, on two opposite sides of which there are components on a flat surface that is expanded in relation to the thickness. With the T-shaped assembly, the extremely expanded flat surfaces of the electrical circuit points are perpendicular to the extremely expanded flat surfaces of the respective insulating devices.

Furthermore, at least one insulating device can be in contact with one of the electrical circuit points. The insulating device can also be partially placed on the respective electrical circuit point, for example. The shavings protection device can be of a height that is greater than the height of a first electrical circuit point and greater than the height of a second electrical circuit point of the two electrical circuit points. At least one of the insulating devices can have a cut-out extending in the insertion direction for at least partially accommodating an electrical circuit point. The shavings protection device is preferably U-shaped in the cross sectional plane, which is perpendicular to the insertion direction, such that the shavings protection device at least partially accommodates the electrical circuit points between the two legs of the U-shape. When the shavings protection device is U-shaped in this manner, it can be used as a bracket or mount for the electrical circuit points. As a result, the two electrical circuit points can be more easily attached to the assembly element in the production process, or during assembly. In other words, the two electrical circuit points can then be inserted into the shavings protection device, or be supported by it.

The shavings protection device can have at least one insertion region in a front region in the insertion direction, that is in the form of a funnel. In other words, the insulating devices can be tapered, at least partially, along the insertion direction as it extends away from the base plate. Tapering in this case refers to a reduction in the cross section. This means that the first and second insulating devices can have surfaces at their free ends that are at an angle to the insertion direction, such that the first and second insulating devices are tapered. Two angled surfaces at the same position in the insertion direction can be located such that the distance between them decreases in the insertion direction. In this manner, a type of insertion funnel is formed by these angled surfaces. As a result, an actuator-side shavings protection device can be more easily threaded between the two adjacent insulating devices, and the assembly element can be more easily installed.

The base plate and the shavings protection device can form an integral element. In this case, "integral" means continuous, or combined to form a single unit. The base plate and the shavings protection device are preferably made of the same material, in a single piece, in particular through injection molding. Alternatively, the shavings protection device can be materially bonded to the base plate.

The base plate can have a cut-out, wherein the cut-out allows for a partial accommodation of a section of an actuator-side assembly element receiver from the insertion direction, and has a width that substantially corresponds to a distance from the first insulating device to the second insulating device.

A system comprising the assembly element described above and an actuator for a vehicle transmission is also provided by the disclosure. The two electrical circuit points on the assembly element can be brought into electrically conductive contact with an electrical circuit point on the actuator. The shavings protection device on the assembly element is designed such that it is located between both the two electrical circuit points on the assembly element and between the two electrical circuit points on the actuator in this state, in which the assembly element is inserted in the actuator. The advantageous path extension described above is further increased by an advantageous meshing of the form elements of the assembly element and the actuator, in particular the cut-out in the assembly element and the assembly element receiver in the actuator.

An assembly element 1 according to a first embodiment is described in reference to FIG. 1. FIG. 1 shows the assembly element 1 in a schematic, i.e. simplified, and perspective illustration.

The assembly element 1 has a rectangular solid-shaped base plate 11, a first and second electrical circuit point 12, 13, and a shavings protection device 14. Both the first and second electrical circuit points 12, 13 extend perpendicularly from a lateral surface of the base plate 11. The first and second electrical circuit points 12, 13 are also rectangular solids in part, more precisely, plate-shaped, and extend in an insertion direction X. The insertion direction X is perpendicular to the lateral surface of the base plate 11, from which the two electrical circuit points 12, 13 extend. The insertion direction X is the direction in which the assembly element 1 is to be inserted into an actuator 2 corresponding to the assembly element 1. The directions Z and Y are each perpendicular to the insertion direction X, wherein the directions Z and Y themselves intersect at a right angle. In other words, the insertion direction X forms a Cartesian coordinate system with the directions Z and Y. The direction Y indicates the width of the assembly element 1, and the direction Z indicates the height of the assembly element 1. The first electrical circuit point 12 has a height Z2 in the vertical direction Z. The second electrical circuit point 13 has a height Z3 in the vertical direction Z. The height Z2 of the first electrical circuit point 12 is the same as the height Z3 of the second electrical circuit point 13.

The shavings protection device 14 has two parts, i.e. it has a first insulating device 141 and a second insulating device 142. In the present case, both the first insulating device 141 and the second insulating device 142 have the same height Z1 in the vertical direction Z. The height Z1 of the first and second insulating devices 141, 142 is greater than the height Z2 of the first electrical circuit point 12 and the height Z3 of the second electrical circuit point 13. In the lateral direction Y, the first electrical circuit point 12 has a width Y2. The second electrical circuit point 13 has a width Y3 in the lateral direction Y. The width Y2 of the first electrical circuit point 12 is the same as the width Y3 of the second electrical circuit point 13. In other words, a cross section of the first and second circuit points 12, 13 is the same size in a cross section plane YZ, to which the insertion direction X is perpendicular.

In the present case, both the first insulating device 141 and the second insulating device 142 have the same width Y1 in the lateral direction Y. In other words, a cross section of the first and second insulating devices 141, 142 is the same size in the cross section plane YZ, to which the insertion direction X is perpendicular. The width Y1 of the first and second insulating devices 141, 142 is greater than the width Y2 of the first electrical circuit point 12 and the width Y3 of the second electrical circuit point 13.

The first electrical circuit point 12 has a length X2 in the insertion direction X. The second electrical circuit point 13 has a length X3 in the insertion direction X. The length X2 of the first electrical circuit point 12 is the same as the length X3 of the second electrical circuit point 13. In other words, the first and second electrical circuit points 12, 13 are the same length in the insertion direction X, starting from the base plate 11.

In the present case, both the first insulating device 141 and the second insulating device 142 have the same length X1 in the insertion direction X. The length X1 of the first and second insulating devices 141, 142 is greater than both the length X2 of the first electrical circuit point 12 and the length X3 of the second electrical circuit point 13. The first electrical circuit point 12, the second electrical circuit point 13, the first insulating device 141 and the second insulating device 142 extend parallel to one another in the insertion direction X.

The base plate 11 also has a cut-out 111. The lateral surfaces of the cut-out 11 extend in an extension of the first and second insulating devices 141, 142 into the interior of the rectangular solid-shaped base plate 11, counter to the insertion direction X. In other words, a width Y4 of the cut-out 111 in the lateral direction Y corresponds to the distance Y5 between the first and second insulating devices 141, 142 in the lateral direction Y. The cut-out 111 in the base plate 11 forms a U-shape with the first and second insulating devices 141, 142 in a plane XY, to which the vertical direction Z is perpendicular. The cut-out 111 is located in the middle of the base plate 11 in the lateral direction Y.

The rectangular solid base plate 11 also has the cut-outs, or holes or openings not shown in FIG. 1. The holes each extend in the insertion direction X from one side of the base plate to the first and second electrical circuit points 12, 13. The side of the base plate 11 from which the holes extend to the first and second electrical circuit points 12, 13 in the insertion direction X is opposite the side of the base plate 11 from which the first and second electrical circuit points 12, 13 project. In other words, the base plate 11 comprises two holes, in order to be able to establish contact with the electrical circuit points 12, 13 from an opposite side of the base plate 11 in the insertion direction X.

The assembly element 1 is symmetrical in relation to a central plane extending in the insertion direction X between the first and second insulating devices 141, 142, which is perpendicular to the plane XY.

Figure 2:
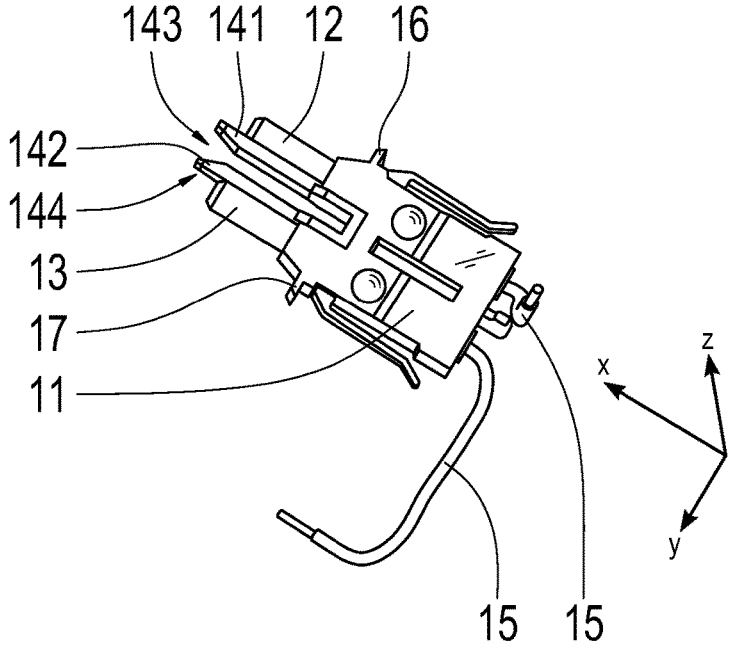
FIG. 2 shows a perspective illustration of an assembly element according to one embodiment.

The assembly element 1 shall now be described in greater detail in reference to FIG. 2. FIG. 2 shows a perspective illustration of the assembly element 1 according to the first embodiment.

Two cables 15 are shown in FIG. 2, which are connected, preferably crimped, in the holes in the base plate 11 described above. The two cables 1 are then connected to leads (not shown), which extend in the base plate 11 to the first and second electrical circuit points 12 and 13. Both the first and second electrical circuit points 12, 13 are accommodated in a cut-out 144 in the first and second insulating devices 141, 142. The cut-out 144 is thus provided in both insulating devices 141, 142. More precisely, both the first and second insulating devices 141, 142 have a U-shaped cross section in the cross section plane YZ. The first and second electrical circuit points 12, 13 are partially accommodated in this U-shaped cross section, more precisely, between the legs of the U-shaped cross section. The first and second insulating devices 141, 142 thus each serve as a track or guide for the first and second electrical circuit points 12, 13 in the insertion direction X.

As described above, the first and second insulating devices 141, 142 are longer than the first and second electrical circuit points 12, 13 in the insertion direction, starting from the base plate 11. The first and second insulating devices 141, 142 thus extend over the respective electrical circuit points 12, 13 in the insertion direction X, which they have partially accommodated in their U-shaped cross sections. The excess of the respective insulating device 141, 142 extending over the respective electrical circuit points 12, 13 has an internal section that is at an angle to the insertion direction X. The excesses of the respective insulating devices 141, 142 thus come to a point in the insertion direction X. The excesses of the first and second insulating devices 141, 142 collectively form a funnel-like insertion region 143 for an actuator-side shavings protection device, or an assembly element receiver 22, respectively. In other words, the insulating devices 141, 142 are tapered along the insertion direction X as they extend away from the base plate 11. The excess, or front section in the insertion direction X, of the first and second insulating devices 141, 142 thus serves as an insertion aid for the assembly element receiver 22, which shall be explained in greater detail below in reference to FIG. 4. The first and second insulating devices 141, 142 serve as tracks, or mounting aids, for the first and second electrical circuit points 12, 13, as described above. They also prevent a short circuit between the first and second electrical circuit points 12, 13, caused, for example, by an electrically conductive metal shaving or conductive abrasives in the transmission fluid.

Figure 3:
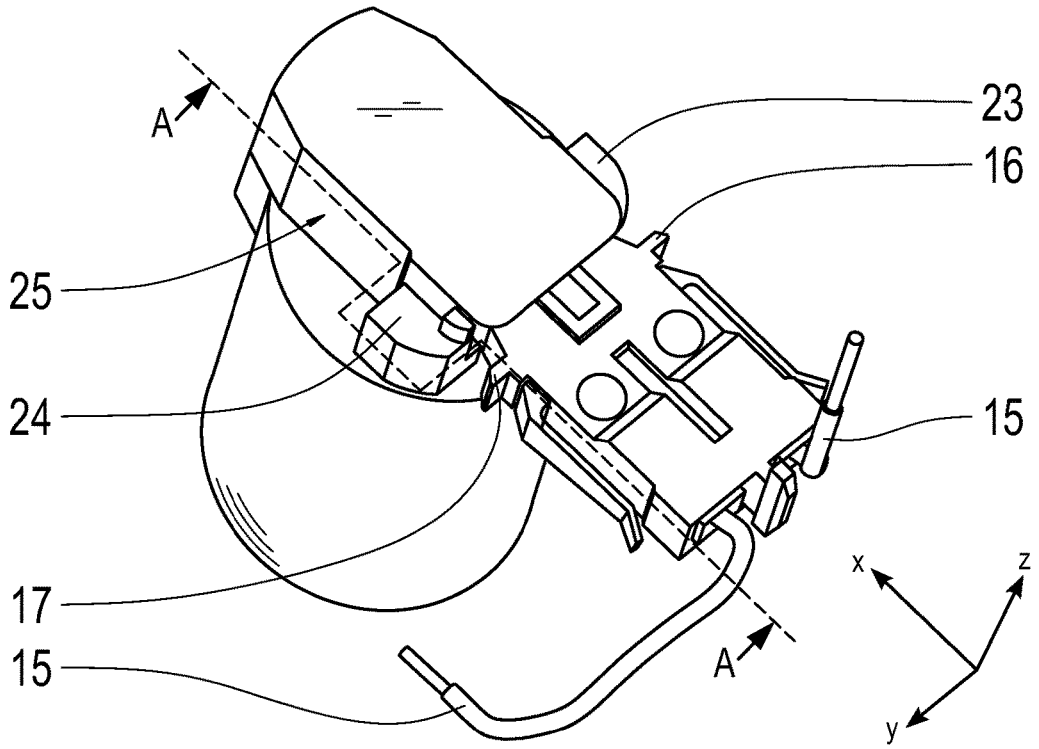
FIG. 3 shows a perspective illustration of a system with the assembly element from FIG. 2 and an actuator according to one embodiment.
Figure 4:
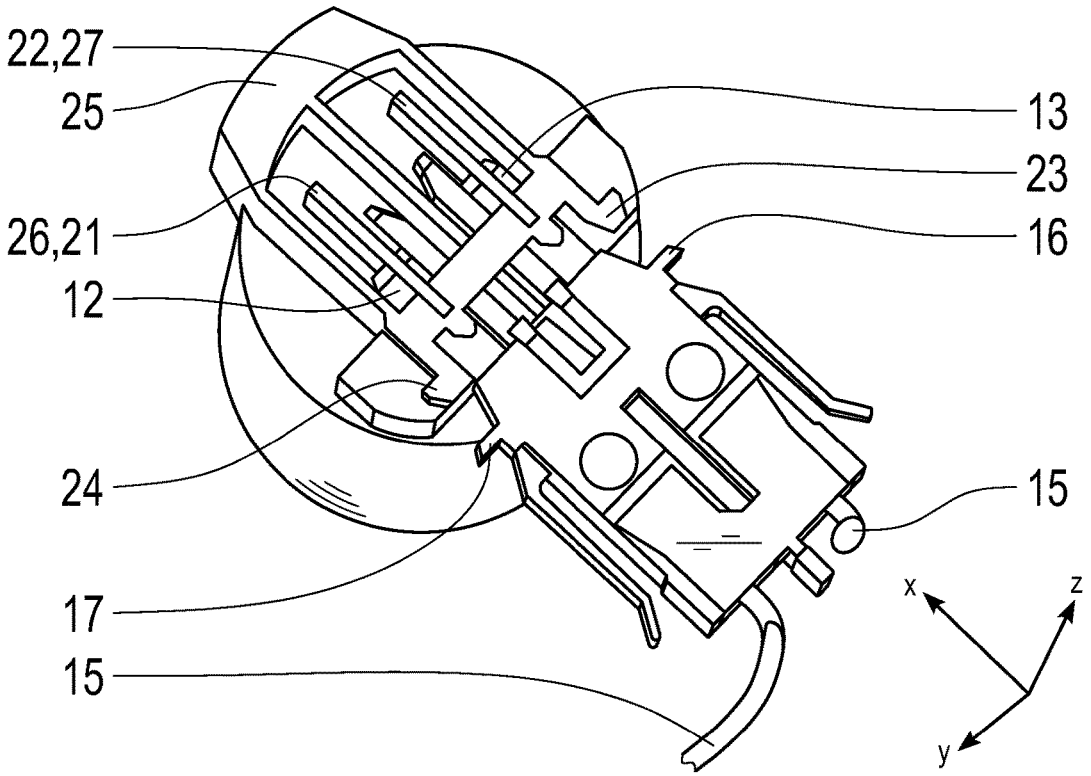
FIG. 4 shows a perspective illustration of the system in FIG. 3, cut along the line A-A in FIG. 3.

A system containing the assembly element 1 from FIG. 2 and an actuator 2 according to the embodiment is shown in a perspective illustration in FIG. 2. FIG. 4 shows a perspective illustration of the system shown in FIG. 3, cut along the line A-A in FIG. 3.

The actuator 2 contains the shavings protection device 22, two mechanical stops 23, 24, an assembly element cap 25, a first actuator-side electrical circuit point 26, and a second actuator-side electrical circuit point 27. The actuator-side shavings protection device 22 is located in the interior of the assembly element cap 25. The actuator-side shavings protection device 22 extends counter to and parallel to the insertion direction X of the assembly element 1. By inserting the assembly element 1 into the actuator 2, the actuator-side shavings protection device 22 is forced between the insulating devices 141, 142 on the assembly element 1. When it is inserted further in the insertion direction X for the assembly element 1, the actuator-side shavings protection device 22 is partially received in the cut-out 111 in the base plate 11. The assembly element 1 is shown in the nearly fully inserted position in the actuator 2 in FIGS. 3 and 4. When the assembly element 1 is inserted further into the actuator 2 in the insertion direction X, mechanical stops 16, 17 of the assembly element 1 come in contact with the mechanical stops 23 and 24 of the actuator 2. As a result, a relative movement of the assembly element 1 to the actuator 2 in the insertion direction X can be prevented in the inserted state. The mechanical stops 16, 17 of the assembly element 1 each extend laterally away from the base plate in the lateral direction Y. In other words, the mechanical stops 16, 17 on the assembly element 1 extend away from the base plate 11 in the lateral direction Y. The mechanical stops 23, 24 on the actuator 2 each extend laterally away from the assembly element cap 25 in the lateral direction Y. In other words, the mechanical stops 23, 24 on the actuator 2 extend away from the assembly element cap 25 in the lateral direction Y.

As can be seen in FIG. 4, the first and second electrical circuit points 12, 13 on the assembly element 1, forming blade contacts, are inserted into first and second electrical circuit points 26 and 27 on the actuator 2, each in the form fork contacts. The fork contacts 21 and 22 receive the blade contacts 12, 13 in the insertion direction X. In other words, an electrically conductive connection between the actuator 2 and the assembly element 1 is established via the fork contacts 21, 22 on the actuator and the blade contacts 12, 13 on the assembly element 1.

Figure 5:
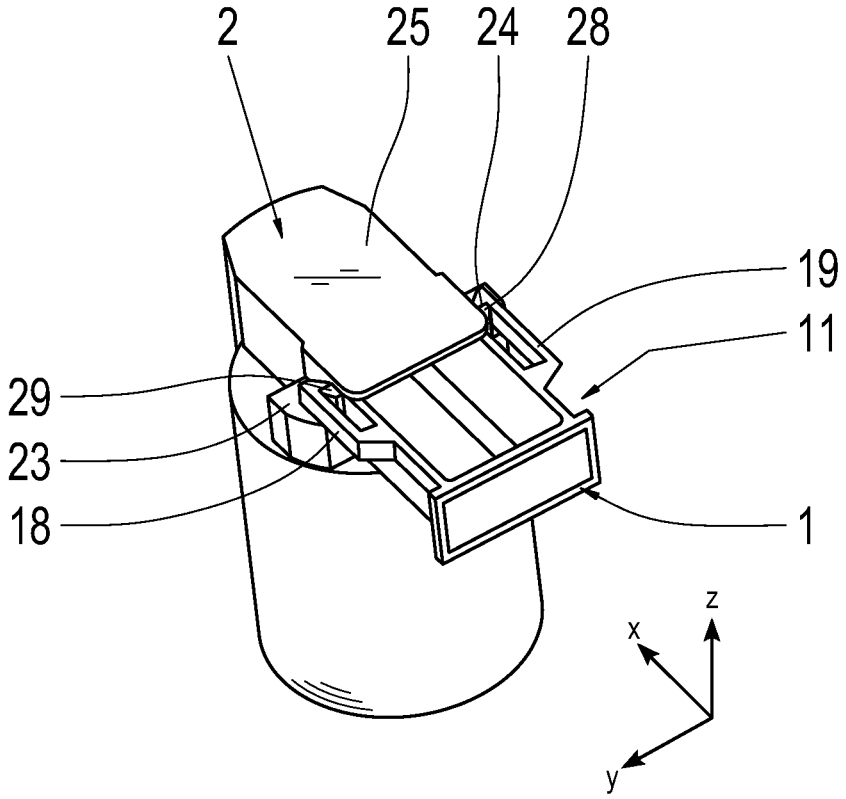
FIG. 5 shows a perspective illustration of a system with an assembly element and an actuator according to another embodiment.

A further embodiment of a system containing an assembly element 1 and an actuator 2 is shown in FIG. 5. The system shown in FIG. 5 has the same fundamental operating principle and the same structural design for the assembly element 1 and the actuator 2 as that described in reference to FIGS. 1 to 4. For this reason, only the differences to the first embodiment shall be described below.

The assembly element 1 according to a second embodiment shown in FIG. 5 is designed as a single plug, and has latching elements 18, 19. The latching elements 18, 19 each correspond to projections 28, 29 on the actuator 2. The latching elements 18, 19 are designed to engage with the projections 28, 29 on the actuator. As a result, a movement of the assembly element 1 in relation to the actuator 2 counter to the insertion direction X can be prevented in the inserted state. The latching elements 18, 19 of the assembly element 1 each extend laterally away from the base plate 11 in the lateral direction Y.

It is possible to combine both embodiments. More precisely, this relates to an assembly element 1 that contains both the mechanical stops 16, 17 and the latching elements 18, 19. As a result, movement of the assembly element 1 in relation to the actuator 2 in the insertion direction X and counter to the insertion direction X can be prevented in the inserted state.

REFERENCE SYMBOLS

1 assembly element
11 base plate
111 cut-out
12 first electrical circuit point (blade contact)
13 second electrical circuit point (blade contact)
14 shaving protection
141 first insulating device
142 second insulating device
143 insertion region
144 cut-out for the shaving protection
15 cable
16 mechanical stop
17 mechanical stop
18 latching element
19 latching element
2 actuator
22 actuator-side shavings protection device (assembly element receiver)
23 mechanical stop
24 mechanical stop
25 assembly element cap
26 first actuator-side electrical circuit point (fork contact)
27 second actuator-side electrical circuit point (fork contact)
28 projection
29 projection
X insertion direction
X1 length of first and second insulating devices
X2 length of first electrical circuit point
X3 length of second electrical circuit point
Y lateral direction
Y1 width of first and second insulating devices
Y2 width of first electrical circuit point
Y3 width of second electrical circuit point
Y4 width of cut-out in base plate
Y5 distance between first and second insulating devices
Z vertical direction
Z1 height of first and second insulating devices
Z2 height of first electrical circuit point
Z3 height of second electrical circuit point

We claim:

1. An assembly element for establishing electrical contact with an actuator for a vehicle transmission, the assembly element comprising:

a base plate; and a first electrical circuit point for abutting a first circuit point of the actuator and a second electrical circuit point for abutting a second circuit point of the actuator, wherein each of the first electrical circuit point and the second electrical circuit point project on respective sides of the base plate of the assembly element, wherein a shavings protection device is located at least partially between the first electrical circuit point and the second electrical circuit point, and wherein the shavings protection device is configured to at least partially impede a short circuit when the assembly element is in contact with the actuator, wherein the shavings protection device includes at least one insulating plate located between the first electrical circuit point and the second electrical circuit point.

2. The assembly element according to claim 1, wherein the first electrical circuit point and the second electrical circuit point extend from the base plate in an insertion direction of the assembly element, and wherein the shavings protection device extends in the insertion direction.

3. The assembly element according to claim 2, wherein the shavings protection device is substantially parallel to a lengthwise direction of at least one of the first electrical circuit point and the second electrical circuit point, and wherein at least one insulating plate of the shavings protection device extends beyond a terminus of each of the first electrical circuit point and the second electrical circuit point in the lengthwise direction measured from the base plate.

4. The assembly element according to claim 2, wherein the shavings protection device overlaps at least a portion of the first electrical circuit point and the second electrical circuit point in the insertion direction.

5. The assembly element according to claim 2, wherein the first electrical circuit point and the second electrical circuit point include a first plate and a second plate, respectively.

6. The assembly element according to claim 5, wherein the shavings protection device has a first insulating plate dedicated to the first plate and a second insulating plate dedicated to the second plate.

7. The assembly element according to claim 6, wherein the first insulating plate and the first plate forms a T-shaped cross-section.

8. The assembly element according to claim 6, wherein the first insulating plate contacts the first electrical circuit point.

9. The assembly element according to claim 8, wherein the first insulating plate includes a cut-out extending in the insertion direction and configured for at least partially receiving an electrical circuit point.

10. The assembly element according to claim 1, wherein the at least one insulating plate has a greater height than a height of at least one of the first electrical circuit point and the second electrical circuit point.

11. The assembly element according to claim 1, wherein the shavings protection device has an insertion region that is at least partially located in at least a funnel-like front region of the assembly element.

12. The assembly element according to claim 1, wherein the base plate and the shavings protection device are integrally formed.

13. A system, comprising:

an assembly element having a base plate;

first electrical circuit point for abutting a first circuit point of an actuator for a vehicle transmission and a second electrical circuit point for abutting a second circuit point of the actuator, wherein each of the first electrical circuit point and the second electrical circuit point project on one side of the base plate of the assembly element; and the actuator for a vehicle transmission, wherein the first electrical circuit point and the second electrical circuit point are each configured to be brought into electrical contact with a corresponding electrical circuit point on the actuator, wherein a shavings protection device of the assembly element is configured to at least partially impede a short circuit when the assembly element is in contact with the actuator, and wherein the shavings protection device is configured such that it is located between the first electrical circuit point and the second electrical circuit point when the assembly element is inserted in the actuator, and wherein the shavings protection device includes at least one insulating plate located between the first electrical circuit point and the second electrical circuit point.

14. The assembly element according to claim 13, wherein the first electrical circuit point and the second electrical circuit point extend from the base plate in an insertion direction of the assembly element, and wherein the shavings protection device extends in the insertion direction.

15. The assembly element according to claim 14, wherein the shavings protection device is substantially parallel to a lengthwise direction of at least one of the first electrical circuit point and the second electrical circuit point.

16. The assembly element according to claim 14, wherein the shavings protection device overlaps at least a portion of the first electrical circuit point and the second electrical circuit point in the insertion direction.

17. The assembly element according to claim 14, wherein the first electrical circuit point and the second electrical circuit point include a first plate and a second plate, respectively.

18. The assembly element according to claim 17, wherein the shavings protection device has a first insulating plate dedicated to the first plate and a second insulating plate dedicated to the second plate.

19. The assembly element according to claim 18, wherein a junction of the first insulating plate and the first plate forms a T-shaped cross-section.

20. An assembly element for establishing electrical contact with an actuator for a vehicle transmission, the assembly element comprising:

a base plate; and a first electrical circuit point and a second electrical circuit point, wherein each of the first electrical circuit point and the second electrical circuit point project on one side of the base plate of the assembly element, wherein a shavings protection device is located at least partially between the first electrical circuit point and the second electrical circuit point, and wherein the shavings protection device is configured to at least partially impede a short circuit when the assembly element is in contact with the actuator, wherein the first electrical circuit point and the second electrical circuit point extend from the base plate in an insertion direction of the assembly element, and wherein the shavings protection device extends in the insertion direction, wherein the first electrical circuit point and the second electrical circuit point include a first plate and a second plate, respectively, wherein the shavings protection device has a first insulating device dedicated to the first plate and a second insulating device dedicated to the second plate, wherein the base plate has a cut-out, wherein the cut-out allows for at least a partial receipt of a section of an actuator-side assembly element receiver from an insertion direction, and wherein the cut-out has a width that substantially corresponds to a distance from the first insulating device to the second insulating device.

* * * * *